United States Patent [19]

Olson

[11] Patent Number: 4,500,125

[45] Date of Patent: Feb. 19, 1985

[54] PET LITTER COLLECTING DEVICE

[76] Inventor: Edward A. Olson, 111 Maolis Ave., Bloomfield, N.J. 07003

[21] Appl. No.: 588,569

[22] Filed: Mar. 12, 1984

[51] Int. Cl.[3] ..... A01K 29/00

[52] U.S. Cl. ..... 294/1 BA

[58] Field of Search ..... 294/1 BA, 1 BB, 1 B, 294/19 R, 55; 15/236 R, 104.8, 257.1, 257.2, 105

[56] References Cited

U.S. PATENT DOCUMENTS 4,191,414 3/1980 Dameron ..... 294/1 BA 4,231,602 11/1980 Kinney ..... 294/1 BA

*Primary Examiner*—James B. Marbert

*Attorney, Agent, or Firm*—Howard E. Thompson, Jr.

[57] ABSTRACT

A pet litter collecting device is provided as a two part receptacle holder and scoop assemblage, said receptacle holder comprising an elongated tubular handle having at one end a fixedly mounted coplanar triangular frame with the remote side of the triangular frame being perpendicular to the axis of said tubular handle, the dimensions of said triangular frame being such as to correspond with the perimeter of the open end of standard plastic sandwich bags whereby folding over the bag edge can securely envelope said frame, hook means at the juncture of said frame and handle for tensionally anchoring a bag edge in engagement with said frame, said scoop comprising an elongated hand grip portion telescopically and detachably fitting within said tubular handle and having at one end thereof a detachable scoop element, with an operative portion disposed perpendicularly to the hand grip member at one side of the axis thereof, the width of said operative portion being somewhat greater than its height and less than the size of the opening provided by the remote edge of said triangular frame, whereby said scoop element, after use, can be received by the bag as the tubular handle and hand grip member are arranged in juxtaposition for carrying purposes. The scoop element can be of planar, hoe-like structure or divided, rake-like structure with the device preferably being provided with both type elements for selective use; and the scoop elements can be of either a permanent and reusable type or a one-use, disposable type.

8 Claims, 7 Drawing Figures

PET LITTER COLLECTING DEVICE

This invention relates to a pet litter collecting device comprising a two part receptacle holder and scoop assemblage, said receptacle holder comprising an elongated tubular handle having at one end a fixedly mounted coplanar triangular frame with the remote side of the triangular frame being perpendicular to the axis of said tubular handle, the dimensions of said triangular frame being such as to correspond with the perimeter of the open end of standard plastic sandwich bags whereby folding over the bag edge can securely envelope said frame, hook means at the juncture of said frame and handle for tensionally anchoring a bag edge in engagement with said frame, said scoop comprising an elongated hand grip portion telescopically and detachably fitting within said tubular handle and having at one end thereof a detachable scoop element, with an operative portion disposed perpendicularly to the hand grip member at one side of the axis thereof, the width of said operative portion being somewhat greater than its height and less than the size of the opening provided by the remote edge of said triangular frame, whereby said scoop element, after use, can be received by the bag as the tubular handle and hand grip member are arranged in juxtaposition for carrying purposes.

The scoop element can be of planar, hoe-like structure or divided, rake-like structure with the device preferably being provided with both type elements for selective use; and the scoop elements can be of either a permanent and reusable type or a one-use, disposable type.

The collecting of pet litter, particularly when walking dogs in urban and suburban areas, is a problem which has long confronted pet owners which has been enhanced by ordinances in most localities requiring clean up by the pet owners.

This problem is being dealt with by improvization on the part of the pet owners or by utilizing various types of collecting devices distributed through pet stores and the like. The commercially available devices fall within two general categories, those of a compact nature which are combined scoop and disposal units intended as one-use, throw away devices, and those with elongated handles and remote controlled means for collecting of litter.

The commercially available devices leave much to be desired, however. The compact, throw-away devices require deep stooping in their use, making them impractical for many individuals, particularly elderly individuals who should avoid deep stooping. Those with elongated handles and remote controls, while eliminating the need for deep stooping, tend to be cumbersome in use and awkward for storage when not in use.

An object of the present invention is to provide a compact, lightweight litter collecting device, which is a unitary assemblage when not in use, which is readily separated to provide a receptacle holder and scoop with handles or grip portions permitting use with moderate bending or stooping, and in which the receptacle holder detachably supports standard, plastic sandwich bags as the disposable litter collecting receptacle.

A further object of the invention is to provide a device of the character described in which the scoop head is detachable and interchangeable, facilitating compact storage and shipment, and selectively providing scoop elements of hoe-like and rake-like configuration, with said scoop elements being of a dimension to be disposed within the collecting receptacle after use.

A still further object of the invention is to provide a modified form of construction wherein the scoop elements of hoe-like and rake-like configuration can be one-use, throw away elements having readily releasable, interlocking engagement with the scoop head.

Novel features of the pet litter collecting device will be readily understood from a consideration of the following description and the accompanying drawing, in which preferred adaptations of the invention have been illustrated with the various parts thereof identified by suitable reference characters in each of the views, in which.

Figure 1:
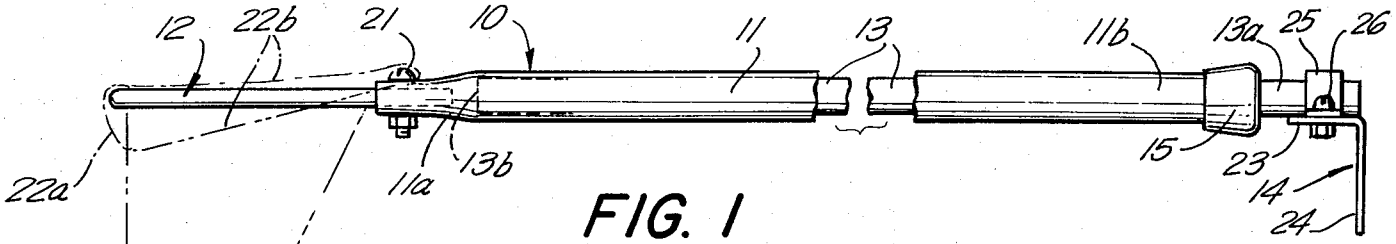
FIG. 1 is a side elevation view of the pet litter collecting device showing in dotted lines an associated collecting container.
Figure 3:
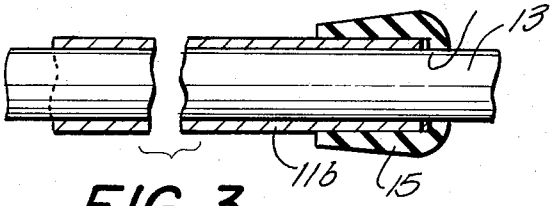
FIG. 3 is an enlarged fragmentary sectional view taken on the line 3—3 of FIG. 2.

As shown in the drawing the pet litter collecting device 10 comprises an elongated tubular handle 11 supporting at one end 11*a* a collecting head 12, and being open at the other end 11*b* to telescopically receive an elongated, cylindrical handle 13 carrying at its free end 13*a* a scraper head 14.

The tubular handle 11 is suitably formed of ½-inch O.D. aluminum tubing and is provided at the open end 11*b* with a ferrule 15 fashioned from rubber or elastomeric plastic having an end opening 16 adapted to snugly and slidably engage the elongated, cylindrical handle 13.

Figure 2:
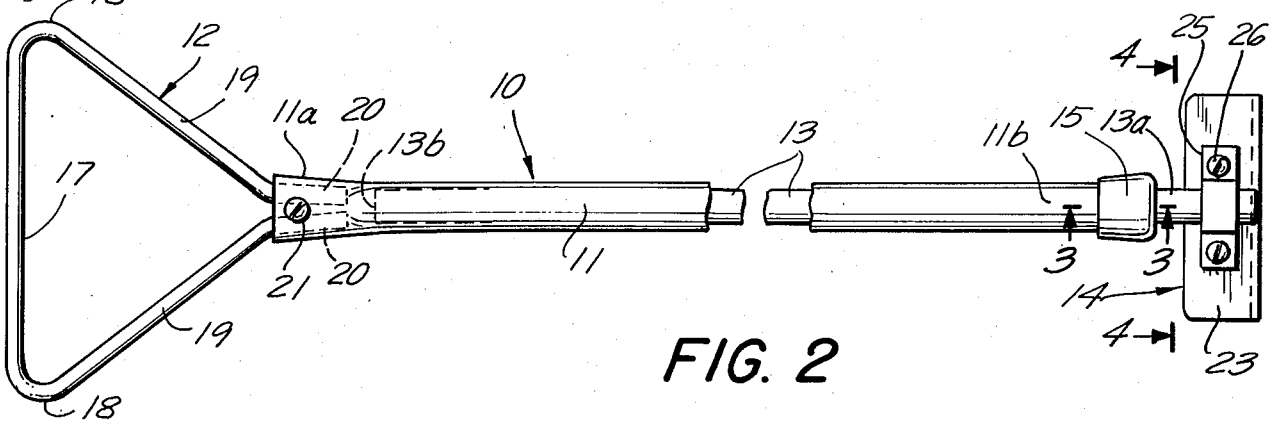
FIG. 2 is a plan view of the assemblage shown in FIG. 1.

The collecting head 12 which, as clearly shown in FIG. 2, has a triangular configuration is suitably formed from aluminum tubing or deformable aluminum wire of about 3/16-inch O.D. shaped to form a base portion 17, rounded corners 18, convergent sides 19, and substantially parallel mounting ends 20 which are inserted in flatened end 11*a* of the tubular handle 11 and firmly positioned therein by a suitable clamping means as indicated by the bolt 21.

The triangular collecting head 12 is intended to support a standard, plastic sandwich bag 22 which measures about 6½ by 9-inches in the flat condition normally supplied. For this size sandwich bag proper support can be provided by the collecting head 12 if the length between the rounded corners 18 is approximately 5½-inches and the distance from the outer extremity of the base portion 17 to the bolt 21 is approximately 4-inches.

The handle 13 carrying scraper head 14 can be fashioned from metal tubing or a wooden or plastic dowel of a diameter to be closely and slidably engaged by end aperture 16 of the ferrule 15, and is of a length to dispose its remote end 13*b*, when fully inserted in the tubular handle 11, adjacent the flatened end 11*a* thereof.

The scraper head 14 is an "L" shaped member of thin but rigid sheet material such as sheet metal or formed rigid plastic material providing a mounting plate portion 23 and a scraper plate portion 24, and is secured to handle end 13*a* by a bracket member 25 positioned by bolts or other adjustable fasteners 26. Note that adjustable fasteners 26 are preferred over permanent fasteners so that the scraper head 14 can be separated from handle 13 for more compact packing and shipping, with the parts being readily assembled by the customer.

The length of the scraper head 14 should be such that the scraper plate portion 24 can freely fit within the triangular collecting head 12 at a point in alignment with the curved corners 18 thereof. In the adaptation shown the scraper head is suitably about $3\frac{1}{3}$-inches long, with the mounting plate 23 being about 1-inch wide and the scraper plate 24 being about 2–$2\frac{1}{4}$-inches wide.

Figure 4:
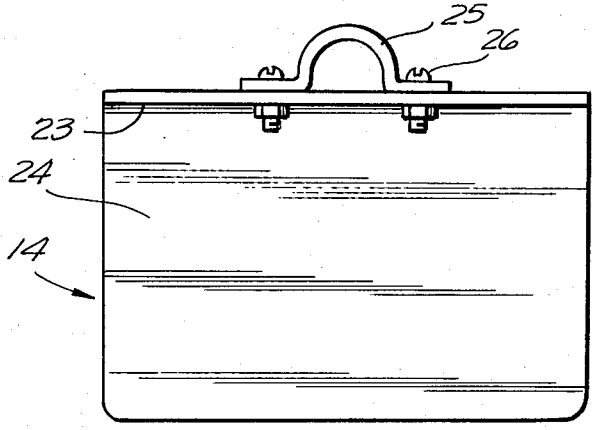
FIG. 4 is a view of the scraper head portion of the device taken in the direction of the arrows 4—4 in FIG. 3.

As shown in FIG. 4 the scraper plate portion 24 of the scraper head is of solid structure, and as such is particularly suited for scraping or lifting pet litter from sidewalks and other hard surfaces.

Figure 5:
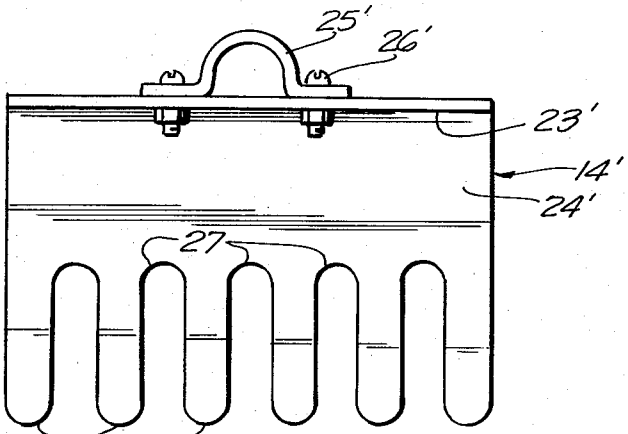
FIG. 5 is a view similar to FIG. 4 showing a modified form of construction.

In the modified scraper head 14' shown in FIG. 5, the scraper plate 24' has a plurality of cutouts 27 extending approximately one-half the width of the plate, and forming a plurality of rake-like teeth 28. The mounting plate 23', bracket 25' and fasteners 26' are the same as shown and described in connection with FIGS. 1, 2 and 4.

The modified scraper head 14' with teeth 28 would be advantageous in suburban areas and the like where there is primarily a need for removing the pet litter from grassy surfaces. Indeed, with the scraper head being readily detachable from the handle 13 it is considered desirable to supply the device with two interchangeable heads 14 and 14' so that the user can adapt the device to his primary, or possibly changing, needs.

Such adapting to different needs can become even more versatile by providing the device with one-use disposable scraper plates having the plain and toothed configuration so that the user can insert the appropriate scraper plate for the particular need.

Figure 7:
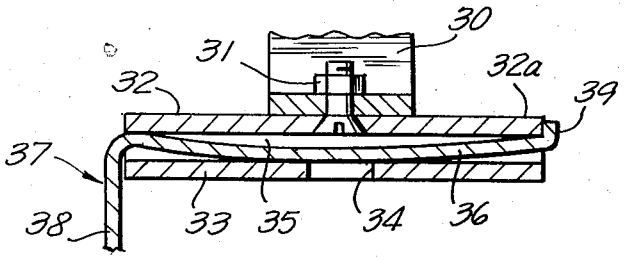
FIG. 7 is a sectional view substantially on the line 7—7 of FIG. 6.
Figure 6:
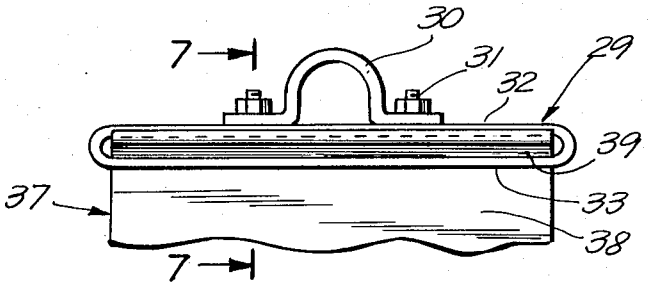
FIG. 6 is a fragmentary view similar to FIG. 4 showing a modified structure for supporting disposable scraper plates.

A preferred approach to adapting the device for use with one-use disposable scraper plates is illustrated in FIGS. 6 and 7. In this approach the mounting plate 23, as previously described, is replaced by a flattened loop member 29 to which a bracket 30 for engagement with handle 13 is attached by bolts 31. The looped member has top wall 32 and bottom wall 33; and it will be noted that the bolts 31, as shown in FIG. 7, engage only top wall 32 and are accessible through aperture 34 in bottom wall 33.

The walls 32 and 33 are spaced to provide a uniform passage 35 to slidably receive mounting portion 36 of a scraper element 37 which is disposed substantially perpendicularly to the scraper plate 38 thereof.

The scraper element 37 can suitably be formed of rigid, plastic material, fiber board or other sheet material having the stiffness required for the intended use. The mounting portion 36 is slightly bowed as indicated in FIG. 7 and has a shallow upwardly extending flange 39 at the edge thereof opposed from scraper plate 38. The dimension of the flange 39 as such as to be freely moved through the passage 35 with the bow in the mounting member 36 causing flange 39 to operatively engage edge 32*a* of the top plate 32.

With the flange 39 thus engaging plate edge 32*a* the scraper element 37 is firmly supported in position for use, but it can be readily disengaged from the loop member 29 by slight downward movement of the flange 39 and pulling on the top of scraper plate 38 to withdraw member 36 from the passage 35.

The one-use disposable scraper elements 37 will, of course, be supplied in both the solid form and the toothed form as illustrated in FIGS. 4 and 5; and it will be apparent that these scraper elements are of a size to be deposited in the collecting bag 22 for disposal purposes.

The width of the scraper plate 24 or 24' may seem somewhat greater than needed for scraper use. This substantial width is provided so that, as the need may arise, the scraper plate can also be effectively used as a "lifting scoop" with which to deposit pet litter in a bag 22 held by the collecting head 12.

The assemblage as shown in FIGS. 1 and 2 is readied for use by folding a conventional sandwich bag in half, lengthwise, while holding the open end, passing the folded bag downwardly through the triangular opening of collecting head 12 with the fold adjacent the bolt 21, grasp the remote edge of the bag top, at the fold, and pass about 1-inch of bag length around the center of the base portion 17 of the triangular frame, as indicated at 22*a* in FIG. 1, work this 1-inch overlap around the two rounded corners 18, then hook the fold portion of the other fold portion of the bag edge over the bolt 21 providing the stretched contours of the bag top substantially as indicated at 22*b*. The bag is thus very securely anchored, while being readily disengaged by unhooking from the bolt 21. A quick movement in an appropriate direction, upwardly as shown in FIG. 1, causes air to expand the bag 22 to substantially the dotted line configuration shown in FIG. 1.

The overall length of the device, as shown in the FIGS. 1 and 2 configuration should be about 23–24-inches. Such a device, and made of the construction materials described, is extremely light, weighing only about 5–6 ounces; yet it is durable and effective for its intended purpose.

When the need for use arises, one merely removes the scraper head 14 with handle 13 from the tubular handle 11 and, with one part in each hand, pet litter is easily scraped or lifted into bag 22 as it is supported by triangular frame 12. The scraper plate 24 of the scraper head 14 is then inserted into bag 22 with the handles 13 and 11 in juxtaposition for collective grasping by one hand, so that the assemblage and contents can readily be carried to a point of disposal.

Various changes and modifications in the pet litter collecting device as herein disclosed may occur to those skilled in the art, and to the extent that such changes and modifications are embraced by the appended claims, it is to be understood that they constitute part of the present invention.

I claim:

1. A pet litter collecting device consisting essentially of a two part receptacle holder and scoop assemblage, said receptacle holder comprising an elongated tubular handle having at one end a fixedly mounted coplanar triangular frame with the remote side of the triangular frame being perpendicular to the axis of said tubular handle, said remote side of the triangular frame joining convergent sides in rounded corners, and said convergent sides terminating in essentially parallel coplanar extensions which are fixedly secured in a flatened end of said tubular handle, the dimensions of said triangular frame being such as to correspond with the perimeter of the open end of standard plastic sandwich bags whereby folding over the bag edge can securely envelope said frame, hook means on said handle at the juncture of said frame and handle for tensionally anchoring a bag edge in engagement with said frame, said hook means being part of the clamping means for fixedly securing said frame extensions to said handle, said scoop comprising an elongated hand grip portion telescopically and detachably fitting within said tubular handle and having at one end thereof a detachable scoop head, said scoop head supporting an operative element disposed perpendicularly to the hand grip member at one side of the axis thereof, the width of said operative portion being somewhat greater than its height and less than the size of the opening provided by the remote edge of said triangular frame, whereby the operative element of said scoop head, after use, can be received by the bag as the tubular handle and hand grip member are arranged in juxtaposition for carrying purposes.

2. A pet litter collecting device as defined in claim 1 wherein the overall length of said assemblage, with the scoop handle fully inserted in the handle of said receptacle holder, is about 23 to 24-inches.

3. A pet litter collecting device as defined in claim 2, wherein said triangular frame has a dimension between said rounded corners of approximately 5½-inches and a dimension between said remote side and said clamping means of about 4-inches.

4. A pet litter collecting device as defined in claim 1, wherein the operative element of said scoop head is of solid, hoe-like construction.

5. A pet litter collecting device as defined in claim 1, wherein the operative element of said scoop head is of transversely divided, rake-like construction.

6. A pet litter collecting device as defined in claim 1, wherein the operative element of said scoop head is an integral, angularly disposed part of said scoop head.

7. A pet litter collecting device as defined in claim 1, wherein said scoop head is in the form of a flattened loop disposed parallel to the axis of said hand grip portion adapted to interlockingly engage an angularly offset mounting portion of said operative element.

8. A pet litter collecting device as defined in claim 7, wherein the free edge of said mounting portion carries a shallow flange for locking engagement with an edge of said scoop head when the mounting portion is fully inserted in the flattened loop of said head.

* * * * *